US006895881B1

(12) United States Patent
Whitaker

(10) Patent No.: US 6,895,881 B1
(45) Date of Patent: May 24, 2005

(54) SHAPE CONFORMING SURFACE COVERING

(76) Inventor: Derek Gordon Whitaker, 29 Welwick Road, Patrington, East Yorkshire, HU12 Orp (GB)

( * ) Notice: Subject to any disclaimer, the term of this patent is extended or adjusted under 35 U.S.C. 154(b) by 13 days.

(21) Appl. No.: 10/018,316

(22) PCT Filed: Jun. 19, 2000 (Under 37 CFR 1.47)

(86) PCT No.: PCT/SE00/01302

§ 371 (c)(1), (2), (4) Date: Aug. 5, 2003

(87) PCT Pub. No.: WO01/00948

PCT Pub. Date: Jan. 4, 2001

(30) Foreign Application Priority Data

Jun. 24, 1999 (GB) ..... 9914848
Oct. 8, 1999 (GB) ..... 9923690

(51) Int. Cl.[7] ..... B63B 5/08

(52) U.S. Cl. ..... 114/85; 52/309.16; 52/592.1; 114/357

(58) Field of Search ..... 114/82, 84, 85, 114/86, 88, 357, 358; 52/578, 590.2, 591.2, 52/592.2, 592.6, 582.1, 586.1, 589.1, 592.1, 52/309.16, 177

(56) References Cited

U.S. PATENT DOCUMENTS

| | | | | |
|---|---|---|---|---|
| 491,417 | A * | 2/1893 | Fincher | 114/86 |
| 1,737,589 | A * | 12/1929 | Jaspert | 52/396.04 |
| 2,250,482 | A * | 7/1941 | Harshberger | 428/168 |
| 2,252,430 | A * | 8/1941 | Arthur | 52/578 |
| 3,593,479 | A * | 7/1971 | Hinds et al. | 52/313 |
| 4,141,944 | A * | 2/1979 | Anstadt et al. | 264/45.5 |
| 4,453,357 | A * | 6/1984 | Zwilgmeyer | 52/309.8 |
| 5,207,172 | A | 5/1993 | Wolter | |
| 6,295,777 | B1 * | 10/2001 | Hunter et al. | 52/519 |

FOREIGN PATENT DOCUMENTS

GB 2000471 A 1/1979

* cited by examiner

*Primary Examiner*—Sherman Basinger
(74) *Attorney, Agent, or Firm*—Birch, Stewart, Kolasch & Birch, LLP

(57) ABSTRACT

A shape conforming surface covering useful for covering any type of surfaces, and comprising planks (1, 2) or sheet of a plastic or flexible material adapted to be interconnected aside of each other thereby forming an assembled surface covering of optional length and width, and which planks (1, 2) or sheet are of a material that can be brought to curved formations, and which at the upper surface of the covering is roughened, for instance sanded or filed so as to imitate any unique grain effect of wooden material. Preferably the planks (1, 2) or sheet are formed with connection means (4, 5) at the longitudinal edges thereof. The surface covering may be an assembled unit comprising planks (1, 2) and caulking elements (3) between each pair of planks.

1 Claim, 4 Drawing Sheets

SHAPE CONFORMING SURFACE COVERING

This application is the national phase under 35 U.S.C. § 371 of PCT International Application No. PCT/SE00/01302 which has an International filing date of Jun. 19, 2000, which designated the United States of America and was published in English.

FIELD OF THE INVENTION

The present invention relates to a shape conforming surface covering useful for covering a floor surface, a wall surface, a boat or yacht deck, floor boards in boats and yachts, bath and shower room floors and walls coverings, swimming pool surroundings, curved floor plans inside and outside buildings, claddings and coverings of many other types of surface recipients, including decoration. The surface covering according to the invention is formed by strips of an flexible material and is adapted for being laid in slightly curved formation where necessary, and it is generally intended to imitate a type of deck made by teak, mahogany, oregon pine etc. and which is sometimes formed with narrow seams by a rubber type material, which is normally of a contrasting colour, often black.

BACKGROUND OF THE INVENTION

There are in use many surface coverings, many of which are made of straight planks with a version of the present invention easily being usable. Some applications, however, require conformity to curved shapes of the covering base. A typical example is teak planked deck of a yacht. Such surfaces have to be of a good, non slip character, and have to be at least fairly unaffected by water and have to look attractive. Wood, such as teak has been used for many years, but such wooden material is in many ways impractical and of relatively short lifespan. Curved wooden surfaces necessitate considerable stressing, preparation like adapting of the wooden ribs to any curved surface, fixing by screws, use of sealing compound and regular maintenance, especially scrubbing, oiling and varnishing and the use of pollutant, cleaning chemicals on a regular basis and in large amounts on boat, in particular these chemicals drain into the surrounding water. Curved wooden ribs or planks also involve an inherent spring stress requiring a strong fixation, generally using screws or bolts. Further, the new look of a teak deck is lost within weeks, and the whole deck requires major work or replacement in four to sex six years on average.

SUMMARY OF THE INVENTION

Ecologically this invention does not require the cutting down of trees and is recyclable. The invention can take the place of tropical hardwoods used throughout the world in many applications.

The present invention is adapted to suggest a shape conforming surface covering comprising lengths of ribs of mostly the same cross section, but with differing cross sections included within the surface or at its edges or ends as required, of specifically shaped plastic material, which plastic ribs are of such flexibility that then can be made to follow at least slightly curved surfaces, tight curves being attainable with the use of heat. The lengths of ribs are adapted to be connected edge to edge in various combinations to form collectively the required size and shape of the surface to be covered. A variation of the invention can be produced with the same material and finish in other cross sections to used for the edges of steps for example, or other functional or decorative applications. Normally a jointing compound must be used on wooden decks, but according to the invention the individual planks and/or caulking strips are malleable, becoming more and more malleable at increasing temperatures. According to the present invention the need for these "later applied" compound along the joints is no longer necessary. The new shapes or curves taken up by the planks or caulking strips become a relatively stress free feature of these planks or caulking strips unless re-adjustment is necessary, whereby re-adjustment can be made by applying heat to the strips, for instance using a hot air gun, hot water, radiant heat etc.

The planks and strips preferably are formed by extrusion of a plastic material and with matching locking means along the longitudinal edges thereof, preferably groove and tenon means. The planks likewise can be formed with narrow strips of a different coulour imitating seams of the type used in applying wooden deck on a yacht. The colours of the described planks and strips can easily be changed in the manufacturing extrusion process.

The surface covering as assembled, complete or in sections, is fixed to the recipient surface by means of an adhesive, and to this end the planks and strips preferably are formed with a suitable bottom surface facilitating the fixing of the covering. There is no need for using screws or bolts and associated holes because captive springing is not a problem as is normally the case with wooden planking made to confirm with a curvature.

The surface covering according to the invention can be subjected various mechanical an manual abrasive techniques for specifically forming the surface of the plastic material such as sanding under specific conditions to provide a surface effect which is extremely similar to that of grained wood both in texture and appearance.

The surface covering according to the invention is advantegous in several respects over ordinary wooden coverings of similar types:

it is completely waterproof; it is easily washable to look new every time, even jet washable what is not possible for ordinary wooden coverings since jet washing is damaging the wood grain; it is extremely non slip, it is extremely stain resistant; it is easy to assemble; it can easily be laid in curvature; it can easily be shaped using heat; there is no need for using nails, screws or bolts for fixing same to the recipient; it is throughout a solid or an integral material which can be sanded repeatedly upon need.

BRIEF DESCRIPTION OF THE DRAWINGS

Now the invention is to be described in detail by way of examples and with reference to the accompanying drawings, in which.

DETAILED DESCRIPTION

Figure 1:
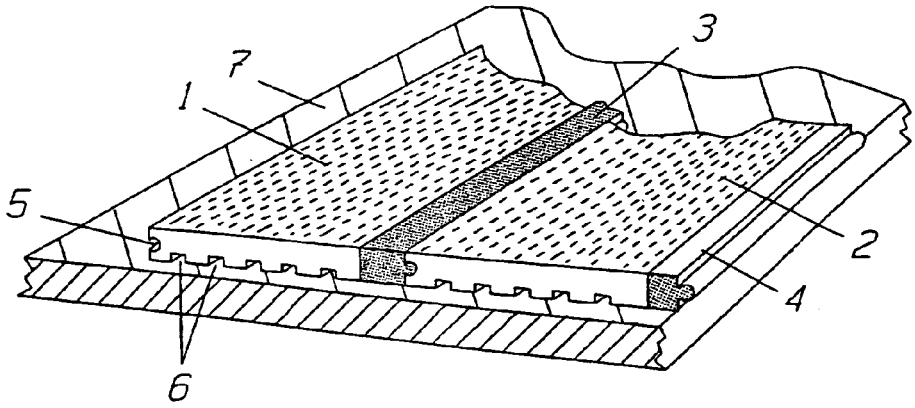
FIG. 1 is a fragmentary perspective view of two plank sections with an intermediate caulking strip.
Figure 3:
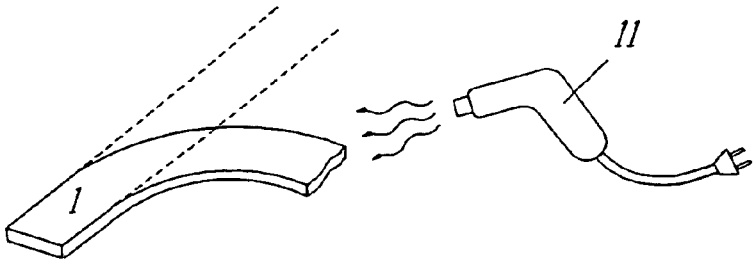
FIG. 3 is a section showing a planking assuming a curved shape.

FIG. 1 shows a surface covering comprising planks 1 and 2 with an intermediate caulking strip 3 between each pair of planks. In the illustrated case the planks 1, 2 are formed with male connection means 4 along one longitudinal edge and female connection means 5 along the opposite longitudinal edge. The caulking strips are formed with equivalent male and female connection means arranged so that a set of planks 1, 2 and intermediate caulking strips 3 provide an integral unit. Adhesive being used in the joint if necessary. Any number of planks 1, 2 can be connected to each other, both with and without intermediate caulking strips 3. The underside of the plank can be formed with a number of recesses 6, which both facilitate a curving of the plank, as illustrated in FIG. 3, and form a connection means for glue or a similar material by means of which the surface covering is glue connected to surface covering recipient 7, as illustrated 11.

In a version of the invention a sheet would be extruded without the caulking strips with the caulking strips co-extruded integral, or with facility to incorporate applied caulking strips.

Both the planks and the caulking strips can be made with different colours, imitating wood like teak, mahogany, pine, oregon pine, redwood, etc. For example, the planks may have a colour and lustre imitating the colour and grain structure of a wooden material. The caulking strips preferably are made of another colour than the planks, for instance a black colour imitating the rubber material seams in seamed decks of yachts. It also retains its colour far better than its' natural wood alternative. Moreover, the planks may be made of a plastic or resin material, such as PVC for example, that may include additives for providing UV protection, fire retardants, and natural or synthetic fibres. The planks may be formed with streaks of lines of colour included in the extrusion to further imitate the grain in wood. The planks may be used as a floor surface, a wall surface a boat or yacht deck, floor board in boats and yachts, bath and shower room floors and walls covering, swimming pool surroundings, curved floor planks inside and outside buildings, claddings and covering of many other types of surfaces. The planks may also be partly filled with a rigid material.

Figure 2:
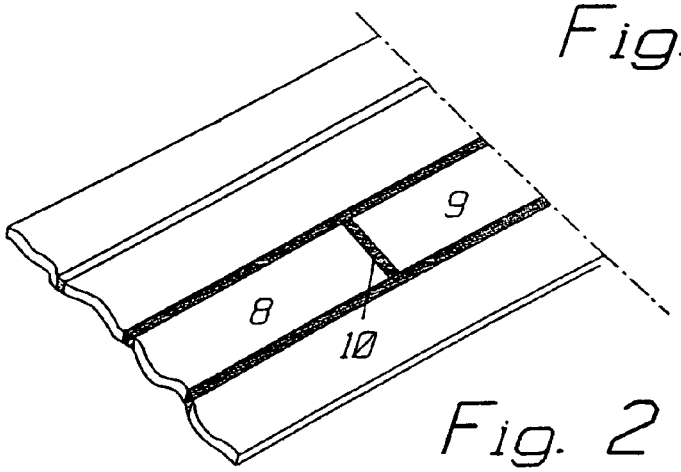
FIG. 2 shows a similar assembled surface with caulking strips in place between the planks.
Figure 4:
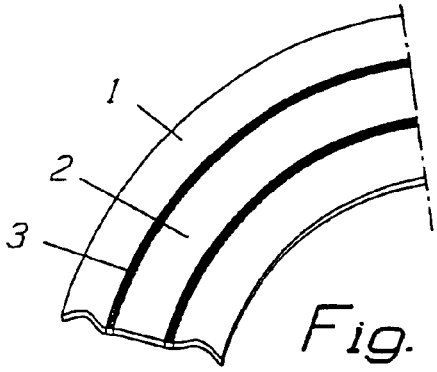
FIG. 4 shows an assembled surface in a curved format.
Figure 6:
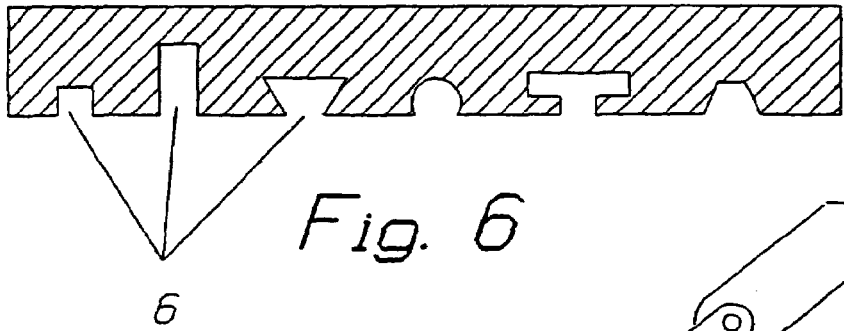
FIG. 6 illustrates various examples of under-surface cross sections.

FIG. 6 illustrates different types of useful under side surface profiles. The cross sections of the various profiles can also include provision for insertion of rigid or injected foam of lighter material to reduce the overall weight, and/or for insulating purposes. The planks 1 and 2 and the caulking strips 3, including the male and female connection means 4, 5 and under surface recesses 6 can be formed in endless lengths by any known process, like injection press extrusion of press moulding. The planks 1 and 2 preferably are formed by a plastic material which is stiff enough for keeping the planks and caulkings together as an integral unit, but which can still be formed in a curvature adapted to the curvature of the recipient 7. Planks can be joined in the longitudinal direction as shown with planks 8 and 9 an a cross extending caulking strip 10 in FIG. 2. The planks can be formed in a curvature preferably using heat from a hot air gun or a hair dryer 11, as indicated in FIG. 3. FIG. 4 fragmentarily shows a curved surface covering consisting of three planks and intermediate caulking strips.

Figure 5A:
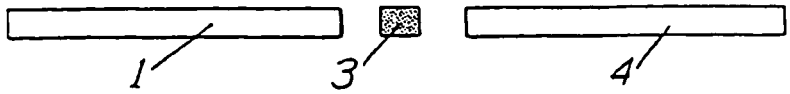
FIGS. 5*a, b, c, d, e, f, g, h, i*, and *j* show cross section examples of methods that can be used to incorporating caulking strips into the surface, FIG. 5*k* (1, 2, 3, 4) shows examples of profiles to complete requirement for edgings, cutting out of shapes etc. to comprises a 'system' or compendium of shapes and profiles.
Figure 5B:
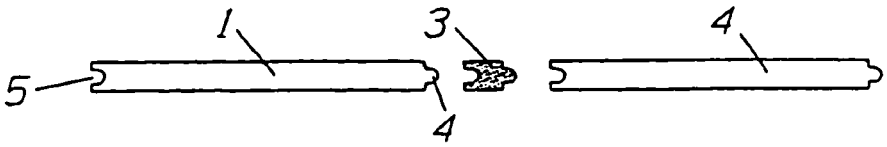
Figure 5C:
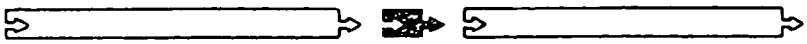
Figure 5D:
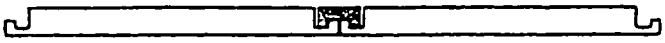
Figure 5E:
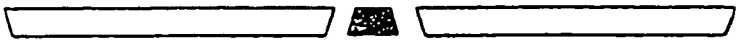
Figure 5F:
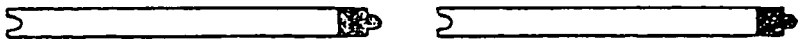
Figure 5G:
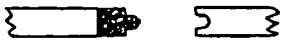
Figure 5H:
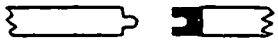
Figure 5I:
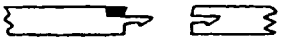
Figure 5J:
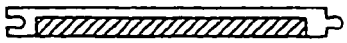
Figure 5K:
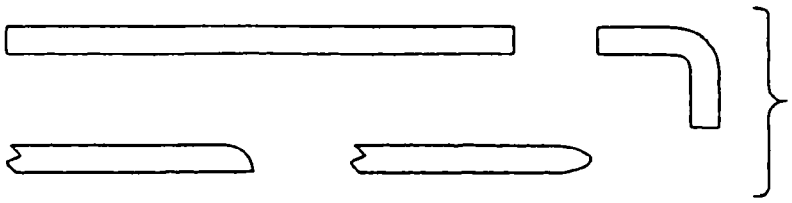

The planks and the caulking strips can be arranged for interconnection in several ways. In FIGS. 5*a* and 5*e* is shown that the planks and the caulking strips have straight side edges and are adapted to be connected by glue or by a welding process; FIGS. 5*b, c*, and f illustrate interconnection of the planks and the caulking strips by means of male and female connection means, and FIG. 5*d* illustrates an interconnection using overlapping portions of the planks and the caulking strips. FIG. 5*f* illustrates that the planks 12 can be co-extruded with a caulking strip 13, whereby, in the illustrated case, the caulking strip 13 is formed with male connection means 4 and the plank 12 is formed with female connection means 5. FIG. 5*g* shows a co-extruded plank and caulking strip with the male connection means in the caulking strip; FIG. 5*h* shows an equivalent co-extrusion in which the caulking strip is formed with female connection means. FIG. 5*i* shows an example of how the upper surface joining profile enables a locking process to take place where the edges are prevented from lifting when the product is assembled, with or without the caulking part of the co-extrusion being under compression upon joining. The male and female connection means are provided in the plank parts, and a caulking strip is applied as a narrow strip on top of a part of the male connection means. FIG. 5*j* shows an embodiment where a section of the plank or of the profiles used in particular applications is filled with foam of a light weight material. Other examples of profiles with or without foam filling to requirements for edgings, cutting out of shapes etc. to comprises a system or compendium or shapes and profiles are shown in FIG. 5*k* (1, 2, 3, 4).

In any of the examples the caulking strip could be a softer material than that of the plank to come under compression, captive or otherwise when the product is assembled FIG. 6 shows a cross section of an extruded plank, in which there are shown, for illustrative purposes, several types of bottom surface recesses.

Figure 7:
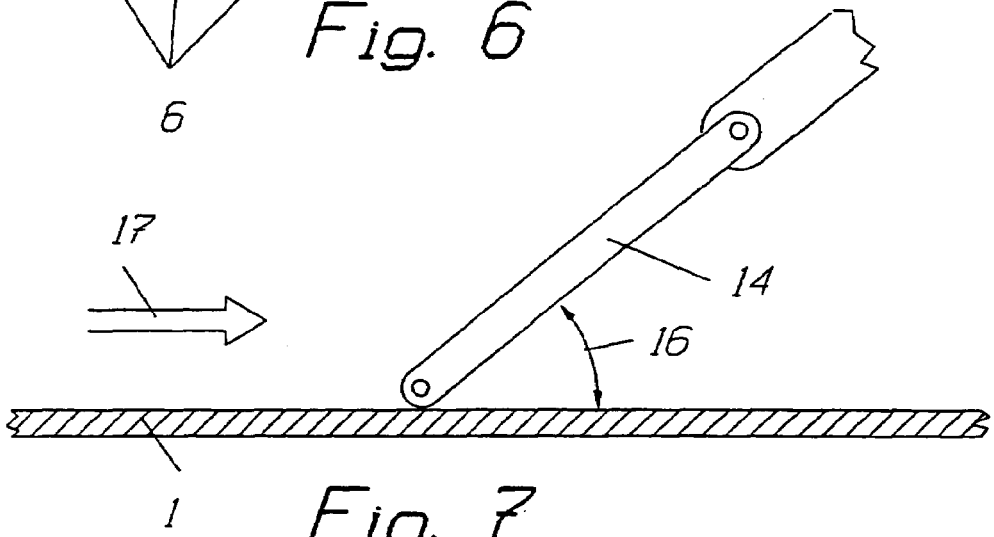
FIG. 7 illustrates a belt sanding operation.

For giving the planks, and the caulking strips a configuration similar to that of wood, the planks are, according to the invention, sanded, for instance using a belt sander 14 a shown in FIG. 7. The belt sander is brought to attack the plank, specifically using the curved or roller part of the sanding belt, in an angle of for instance 45° and is moved along the plank in direction shown with the arrow. A rotary wire brush can also be used in specific conditions to produce a desired effect, in required. At the same time as giving the planks a wooden like surface structure said sanding makes the upper surface of the surface covering an extremely non slip structure. The sanding operation can be repeated a great many times, even in the laid surface covering.

Figure 8:
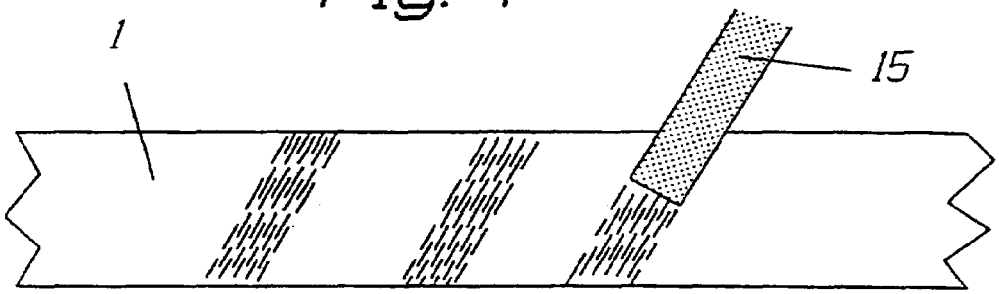
FIG. 8 illustrates an alternative texturing technique.

FIG. 8 shows an alternative type of sanding the planks, whereby the belt sander acts at an angle of about 60° to the longitudinal direction of the planks. Said angular strokes across the surface will produce individual effects using a powerfile 15.

Figure 9:
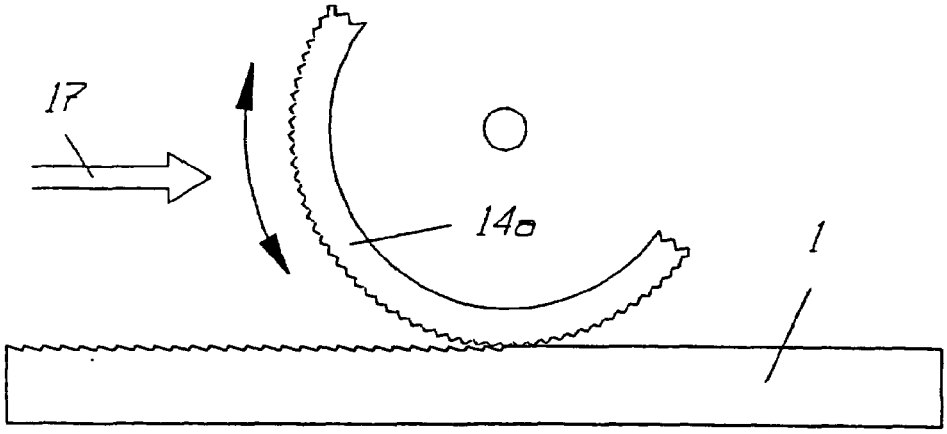
FIG. 9 shows an alternative abrasive tool 14*a* that can be used to produce the wood grain effect surface.

FIG. 9 shows diagrammatically how an abrasive rotary tool can be used to produce the wool grain effect on the upper surface of the plank. By changing certain certain conditions various effects can be obtained like the meeting angle 16 in FIG. 7, the speed of rotation in FIG. 9, the coarsness of grit, the direction of stroke 17, which conditions are of importance to react with the formulation of the plastic surface to produce the unique grain effect.

Figure 10:
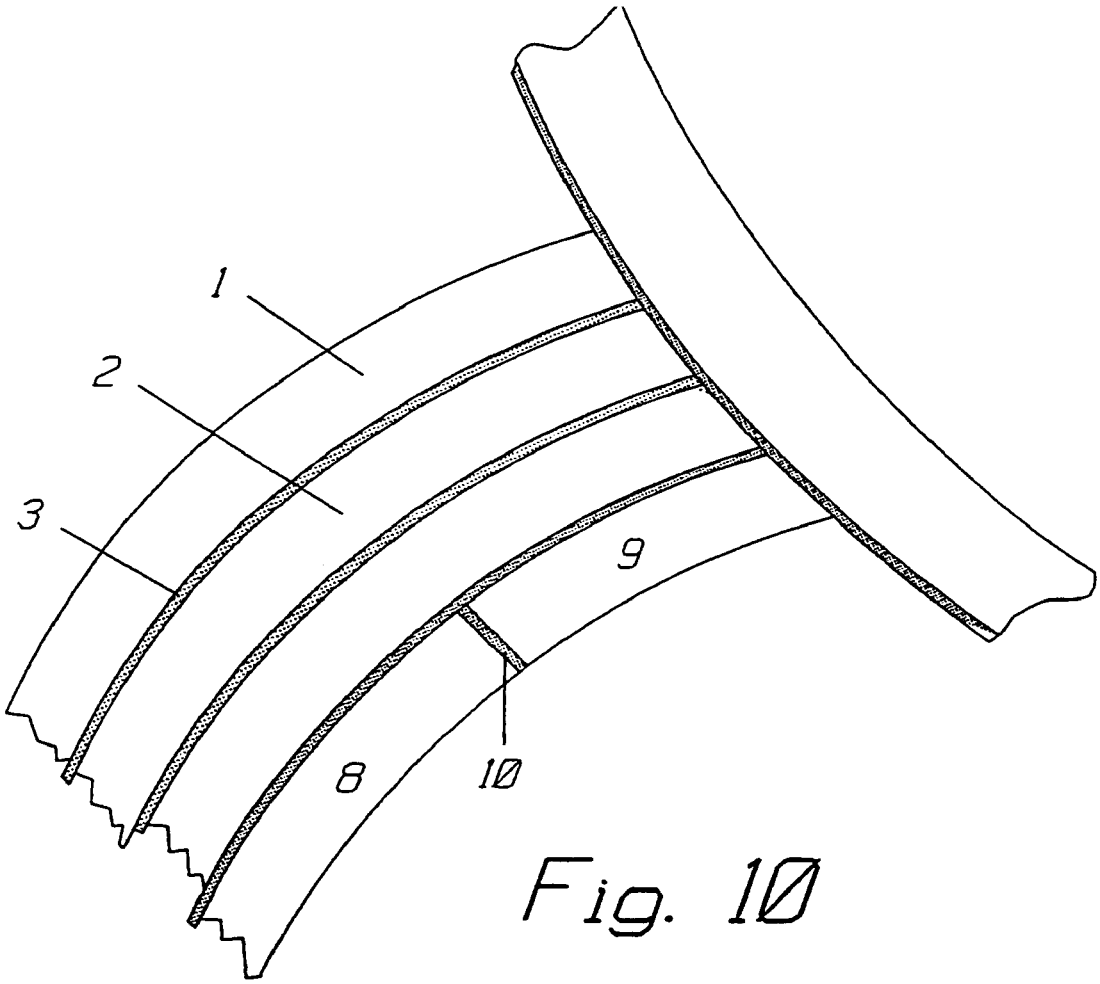
FIG. 10 illustrates an assembled curved section of a surface in plan view.

FIG. 10 shows an example of use of a piece of surface covering or a curved border type plank mounted in contact with another cross extending border plank, like a plank sheer of a yacht.

Figure 11:
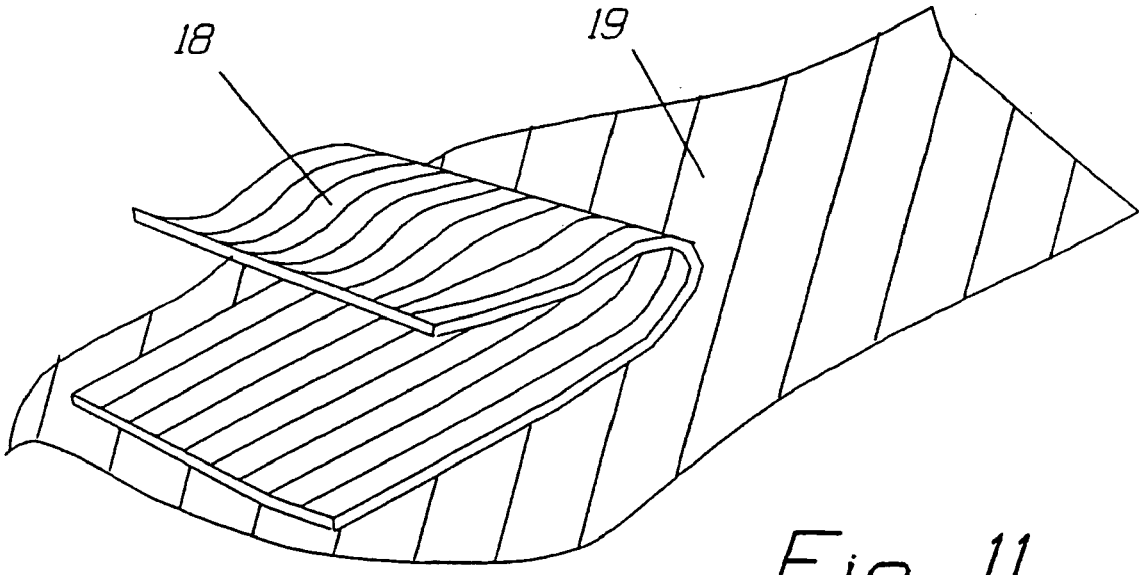
FIG. 11 illustrates a way of laying the surface.

The assembled surface covering material 18 is glued at the bottom side thereof and laid as shown in FIG. 11 by rolling the back of the covering material onto the recepient surface 19. Cutting and trimming of the surface covering is readily achieved, for instance with the use of a sharp knife.

REFERENCE NUMERALS

1 plank
2 plank
3 caulking strip
4 male connection means
5 female connection means
6 recess
7 recipient
8 plank
9 plank
10 cross caulking strip
11 hot air gun, hair dryer
14 belt sander
14*a* abrasive tool
15 powerfile
16 angle
17 direction of stroke
18 covering material
19 recipient surface

What is claimed is:

1. A shape conforming surface covering useful for covering any type of surfaces, characterized in that the surface covering comprises planks or sheet of a flexible material adapted to be interconnected aside of each other thereby forming an assembled surface covering of optional length and width, and which planks are of a material that can be laid in curved formations, and which at the upper surface of the covering is roughened so as to imitate any unique grain effect of wooden material, further characterized in that the planks or sheet are formed with longitudinal slots at the underside thereof for facilitating forming of curved coverings and for acting as a base for a glue or adhesive material by means of which the surface covering is mounted on a surface recipient.

* * * * *

US006895881C1

(12) EX PARTE REEXAMINATION CERTIFICATE (8731st)

United States Patent

Whitaker

(10) Number: US 6,895,881 C1

(45) Certificate Issued: Dec. 6, 2011

(54) SHAPE CONFORMING SURFACE COVERING

(75) Inventor: Derek Gordon Whitaker, Patrington (GB)

(73) Assignee: Flexiteek International AS, Oslo (NO)

Reexamination Request:
No. 90/009,533, Aug. 26, 2009

Reexamination Certificate for:

| | |
|---|---|
| Patent No.: | **6,895,881** |
| Issued: | **May 24, 2005** |
| Appl. No.: | **10/018,316** |
| Filed: | **Aug. 5, 2003** |

(22) PCT Filed: Jun. 19, 2000

(86) PCT No.: PCT/SE00/01302

§ 371 (c)(1), (2), (4) Date: Aug. 5, 2003

(87) PCT Pub. No.: WO01/00948

PCT Pub. Date: Jan. 4, 2001

(30) Foreign Application Priority Data

Jun. 24, 1999 (GB) ..... 9914848
Oct. 8, 1999 (GB) ..... 9923690

(51) Int. Cl.

| | |
|---|---|
| ***B63B 5/00*** | (2006.01) |
| ***B63B 5/08*** | (2006.01) |
| ***E04F 15/10*** | (2006.01) |
| ***E04F 15/02*** | (2006.01) |
| ***E04F 13/08*** | (2006.01) |
| ***E04F 13/18*** | (2006.01) |

(52) U.S. Cl. ..... 114/85; 114/357; 52/309.16; 52/592.1

(58) Field of Classification Search ..... None
See application file for complete search history.

(56) References Cited

To view the complete listing of prior art documents cited during the proceeding for Reexamination Control Number 90/009,533, please refer to the USPTO's public Patent Application Information Retrieval (PAIR) system under the Display References tab.

*Primary Examiner*—Peter C. English

(57) ABSTRACT

A shape conforming surface covering useful for covering any type of surfaces, and comprising planks (1, 2) or sheet of a plastic or flexible material adapted to be interconnected aside of each other thereby forming an assembled surface covering of optional length and width, and which planks (1, 2) or sheet are of a material that can be brought to curved formations, and which at the upper surface of the covering is roughened, for instance sanded or filed so as to imitate any unique grain effect of wooden material. Preferably the planks (1, 2) or sheet are formed with connection means (4, 5) at the longitudinal edges thereof. The surface covering may be an assembled unit comprising planks (1, 2) and caulking elements (3) between each pair of planks.

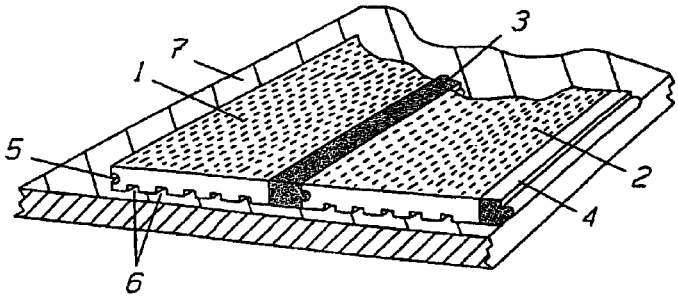

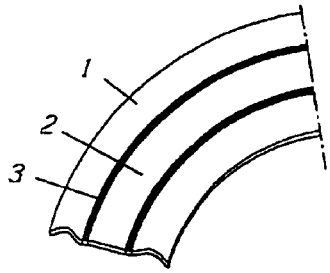

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is cancelled.

New claims 2-29 are added and determined to be patentable.

*2. The shape conforming surface covering of claim 1, wherein the planks or sheet are mounted on the surface recipient in a tightly curved formation only with adhesive and without use of additional fasteners.*

*3. The shape conforming surface covering of claim 1,*

*wherein the planks or sheet are formed with a plurality of longitudinal slots at the underside thereof for facilitating forming of the curved coverings,*

*wherein the planks or sheet are formed with connection means;*

*wherein the connection means includes intermediate caulking strips;*

*wherein the planks or sheet are co-extruded with one of the intermediate caulking strips,*

*wherein the planks or sheet co-extruded with the caulking strip includes a male connection member formed on one of the planks or sheet and the caulking strip, and a female connection member formed on the other of the planks or sheet and the caulking strip;*

*and the planks or sheet includes a grain appearance surface and a color, and the caulking strips have a different color.*

*4. The shape conforming surface covering of claim 3, wherein the intermediate caulking strips have lower surfaces without longitudinal slots.*

*5. The shape conforming surface covering of claim 3, wherein the surface covering is waterproof.*

*6. The shape conforming surface covering of claim 1,*

*wherein the planks or sheet are formed with interconnectors so that the planks or sheet are to be interconnected aside of each other along longitudinal edges of the planks or sheet,*

*wherein the interconnectors include intermediate caulking strips, and*

*wherein the planks or sheet are co-extruded with one of the intermediate caulking strips, and the planks or sheet includes a grain appearance surface and a color, and the caulking strips have a different color.*

*7. The shape conforming surface covering of claim 1,*

*wherein the planks or sheet are formed with a plurality of longitudinal slots at the underside thereof for facilitating forming of the curved coverings,*

*wherein the planks or sheet are formed with interconnectors so that the planks or sheet are to be interconnected aside of each other along longitudinal edges of the planks or sheet,*

*wherein the interconnectors include intermediate caulking strips so that a set of one of the planks or sheet and one of the intermediate caulking strips form an integral unit, and*

*wherein the planks or sheet are co-extruded with one of the intermediate caulking strips, and the planks or sheet have a grain appearance surface.*

*8. The shape conforming surface covering of claim 1,*

*wherein the planks or sheet are formed with caulking strips welded along one side, to form an integral unit, and*

*wherein the surface covering is waterproof.*

*9. A shape conforming surface covering useful for covering any type of surfaces, characterized in that the surface covering comprises planks or sheet of flexible material adapted to be interconnected aside of each other thereby forming an assembled surface covering of optional length and width, and which planks are of a material that can be laid in curved formations, and which at the upper surface of the covering is roughened so as to imitate any unique grain effect of wooden material, further characterized in that the planks or sheet are formed with longitudinal slots at the underside thereof for facilitating forming of curved coverings and for acting as a base for a glue or adhesive material by means of which the surface covering is mounted on a surface recipient,*

*wherein the planks or sheet are capable of being laid in tightly curved formations only with adhesive, and without use of additional fasteners; and*

*wherein the planks or sheet are co-extruded with a respective intermediate caulking strip to form an integral unit.*

*10. The shape conforming surface covering of claim 9, wherein each intermediate caulking strip has a lower surface without longitudinal slots.*

*11. The shape conforming surface covering of claim 9, wherein the surface covering with the co-extruded planks or sheet with the respective intermediate caulking strip is waterproof.*

*12. A shape conforming surface covering useful for covering any type of surfaces, characterized in that the surface covering comprises planks or sheet of flexible material adapted to be interconnected aside of each other thereby forming an assembled surface covering of optional length and width, and which planks are of material that can be laid in curved formations, and which at the upper surface of the covering is roughened so as to imitate any unique grain effect of wooden material, further characterized in that the planks or sheet are formed with longitudinal slots at the underside thereof facilitating forming of curved coverings and for acting as a base for a glue or adhesive material by means of which the surface covering is mounted on a surface recipient,*

*wherein the planks or sheet are capable of being laid in tightly curved formations only with adhesive, and without use of additonal fasteners; and*

*wherein the planks or sheet are co-extruded with intermediate caulking strips, and the planks or sheet includes a grain appearance surface and a color, and the caulking strips have a different color.*

*13. The shape conforming surface covering of claim 12, wherein each intermediate caulking strip has a lower surface without longitudinal slots.*

*14. The shape conforming surface covering of claim 12, wherein the surface covering is waterproof.*

*15. A shape conforming surface covering useful for covering any type of surfaces, characterized in that the surface covering comprises planks or sheet of flexible material adapted to be interconnected aside of each other thereby forming an assembled surface covering of optional length and width, and which planks are of a material that can be laid in curved formations, and which at the upper surface of the covering is roughened so as to imitate any unique grain effect of wooden material, further characterized in that the planks or sheet are formed with longitudinal slots at the underside thereof for facilitating forming of curved coverings and for acting as a base for a glue or adhesive material by means of which the surface covering is mounted on a surface recipient,*

*wherein the planks or sheet are mounted on the surface recipient in tightly curved formations only with adhesive, and without use of additional fasteners, and*

*wherein the surface covering is waterproof.*

*16. The shape conforming surface covering of claim 15, wherein the planks or sheet are co-extruded with intermediate caulking strips, and wherein the planks or sheet have a grain appearance surface.*

*17. The shape forming surface covering of claim 15, wherein the planks or sheet are co-extruded with intermediate caulking strips, and wherein the planks or sheet have one color and the intermediate caulking strips have a different color.*

*18. A shape conforming surface covering useful for covering a boat or yacht deck, characterized in that the surface covering comprises planks or sheet of flexible material adapted to be interconnected aside of each other thereby forming an assembled surface covering of optional length and width, and which planks are of a material that can be laid in curved formations, and which at the upper surface of the covering is roughened so as to imitate any unique grain effect of wooden material, further characterized in that the planks or sheet are formed with longitudinal slots at the underside thereof for facilitating forming of curved coverings and for acting as a base for a glue or adhesive material by means of which the surface covering is mounted on a surface recipient of a boat or yacht deck, and*

*wherein the planks or sheet are mounted on the surface recipient in tightly curved formations only with adhesive, and without use of additional fasteners.*

*19. The shape conforming surface covering of claim 18,*

*wherein the planks or sheet are formed with interconnectors so that the planks or sheet are to be interconnected aside of each other along longitudinal edges of the planks or sheet,*

*wherein the interconnectors include intermediate caulking strips so that a set of the planks or sheet and one of the intermediate caulking strips form an integral unit, and*

*wherein the planks or sheet are co-extruded with one of the intermediate caulking strips, and the planks or sheet have a grain appearance surface.*

*20. The shape conforming surface covering of claim 19,*

*wherein the planks or sheet have one color and the intermediate caulking strips have a different color.*

*21. The shape conforming surface covering of claim 19, wherein the surface covering is waterproof.*

*22. A shape conforming surface covering useful for covering a boat or yacht deck, said surface covering being made of a flexible plastic or resin material that can be laid in curved formations having a color and luster imitating the grain effect of a wooden teak, mahogany, pine, Oregon pine, or redwood, and which, at the upper surface of the covering, is roughened, so as to imitate any unique grain effect of wooden material, in which*

*the surface covering is made up by plank strips, that are formed with longitudinal slots at the underside thereof for facilitating forming of curved coverings and for acting as a base for a glue or adhesive material by means of which the surface covering is mounted on a surface recipient, and*

*in which the plank strips are each co-extruded with a caulking strip to form an integral unit, and*

*in which the plank strips are of a color and luster imitating the color and grain structure of a wooden material, and the caulking strips are of a different color, characterized in*

*wherein each plank strip and co-extruded caulking strip includes a male connection member formed on one longitudinal side edge of the integral unit, and a female connection member formed on another longitudinal side edge of the integral unit.*

*23. The surface covering according to claim 22, characterized in that each integral unit is mateably attachable to another integral unit when matching the male connection member along one longitudinal side edge of the integral unit with the female connection member along an opposite longitudinal side edge of the another integral unit.*

*24. The surface covering according to claim 22, wherein the caulking strips have no longitudinal slots underneath.*

*25. The surface covering according to claim 22, wherein the surface covering is waterproof.*

*26. The surface covering according to claim 22, wherein each plank strip and each caulking strip is capable of being laid in a tightly curved formation, with each plank strip and each caulking strip being secured only with adhesive, without the use of additional fasteners.*

*27. A shape conforming surface covering useful for covering a boat or yacht deck, characterized in that the surface covering comprises planks or sheet of flexible material adapted to be interconnected aside of each other thereby forming an assembled surface covering of optional length and width, and which planks are of a material that can be laid in curved formations, and which at the upper surface of the covering is roughened so as to imitate any unique grain effect of wooden material, further characterized in that the planks or sheet are formed with longitudinal slots at the underside thereof for facilitating forming of curved coverings and for acting as a base for a glue or adhesive material by means of which the surface covering is mounted on a surface recipient,*

*wherein the planks or sheet are formed with a plurality of longitudinal slots at the underside thereof for facilitating forming of the curved coverings,*

*wherein the planks or sheet are formed with interconnectors so that the planks or sheet are to be interconnected aside of each other along longitudinal edges of the planks or sheet,*

*wherein the interconnectors include intermediate caulking strips so that a set of one of the planks or sheet and one of the intermediate caulking strips form an integral unit, and*

*wherein the planks or sheet are each co-extruded with one of the intermediate caulking strips, and the planks or*

*sheet have one color and the caulking strips have a different color.*

*28. The surface covering according to claim 27, wherein the planks or sheet are mounted on the surface recipient in a tightly curved formation only with adhesive, and without use of additional fasteners.*

*29. The shape conforming surface covering of claim 27, wherein the planks or sheet have a grain appearance surface.*

* * * * *